United States Patent [19]

Webb

[11] Patent Number: 4,869,172

[45] Date of Patent: Sep. 26, 1989

[54] SAFE AND ARM DEVICE FOR SPINNING MUNITIONS

[75] Inventor: George Webb, Larwill, Ind.

[73] Assignee: Magnavox Government and Industrial Electronics Company, Fort Wayne, Ind.

[21] Appl. No.: 267,055

[22] Filed: Nov. 4, 1988

Related U.S. Application Data

[62] Division of Ser. No. 119,801, Nov. 12, 1987, Pat. No. 4,796,532.

[51] Int. Cl.[4] ..... F42C 15/04; F42C 15/26

[52] U.S. Cl. ..... 102/233; 102/235

[58] Field of Search ..... 102/235, 233, 232, 254, 102/255, 258

[56] References Cited

U.S. PATENT DOCUMENTS

| | | | |
|---|---|---|---|
| 3,603,259 | 9/1971 | Webb | 102/235 |
| 3,830,159 | 8/1974 | Ranalli et al. | 102/235 |
| 4,419,934 | 12/1983 | Apothéloz | 102/233 |
| 4,464,991 | 8/1984 | Kaiser | 102/235 |
| 4,677,914 | 7/1987 | Apothéloz | 102/233 |
| 4,691,634 | 9/1987 | Titus | 102/235 |
| 4,770,096 | 9/1988 | Maruska et al. | 102/235 |

*Primary Examiner*—David H. Brown

*Attorney, Agent, or Firm*—Roger M. Rickert; Thomas A. Briody; Richard T. Seeger

[57] ABSTRACT

The invention relates to a safe and arm mechanism for an exploding projectile to be fired from a rifled gun. The projectile first experiences axial and angular acceleration which moves a setback ball to initially arm the mechanism. A third projectile parameter, angular velocity, functions to lock the ball in the armed position. During projectile flight, a spin actuated escapement mechanism moves toward a fully armed position, but may be precluded from reaching that fully armed position by a command arm arrangement. The projectile is then fully armed when a command arm signal releases the arrangement and the escapement mechanism is allowed to complete its motion to the fully armed position. When the projectile strikes a target, it experiences axial deceleration which moves a contact ball partway to a detonating position. After the projectile passes through the target surface and into a void, e.g., into the hull of a ship, the deceleration ceases and the contact ball moves under centrifugal force to a final position to detonate the projectile.

7 Claims, 7 Drawing Sheets

SAFE AND ARM DEVICE FOR SPINNING MUNITIONS

This is a divisional application of application Ser. No. 119,801, filed Nov. 12, 1987, U.S. Pat. No. 4,796,532.

SUMMARY OF THE INVENTION

The present invention relates generally to active projectiles and more particularly to a safe and arm mechanism in conjunction with command arming and void sensing features for such projectiles.

A great deal of technology on large caliber explosive shells such as artillery shells has been developed. Such artillery shells have a projectile which carries an explosive charge which typically either explodes on impact with a target or explodes a preset time after being discharged from a gun. Timed burning fuses, mechanical impact actuated explosive materials, and electrical detonating devices which are actuated upon impact have been successfully employed.

Void sensing devices which allow a projectile to penetrate a wall such as a ship's hull and then explode the shell within the interior of the ship have also been considered. These void sensing devices frequently use a piezoelectric crystal which senses impact or deceleration and then senses the absence of that deceleration. Impact switches which detonate the projectile a predetermined time after the initial impact when it is assumed the projectile has entered the void have also been used. Neither of these void sensing schemes relies on any indication of the distance the projectile has traveled into the void.

In my prior U.S. Pat. No. 3,603,259 there is disclosed a primary safety lock or setback device employing a leaf spring and a ball which deforms that spring upon axial acceleration to arm an impact exploding projectile. In this prior arrangement, only two projectile parameters, namely linear (axial) acceleration and angular acceleration are relied on to move the ball from the safe to the armed position.

Escapement mechanisms which fully arm a projectile a preset distance after the projectile is fired are also known, but the prior art has failed to incorporate a command arming feature into these escapement mechanisms. These mechanisms function as turns integrators which, for a given twist, velocity and caliber, translates into distance. The Apotheloz U.S. Pat. Nos. 4,419,934 and 4,677,914 are illustrative of such devices as is the M724 fuse safe and arm type runaway escapement which is currently in ordinance use.

Among the several objects of the present invention may be noted the provision of enhanced safety and improved reliability in explosive munitions; the provision of a safe and arm mechanism for a projectile requiring three projectile motion parameters to arm the projectile; the provision of a void sensor which is armed by a delay arming escapement mechanism, senses impact, and integrates distance after impact deceleration falls below a predetermined value; the provision of a command arming feature which holds a primary arming device such as an escapement mechanism in an intermediate partly armed, but safe position until triggered by an electrical signal to release the primary arming device; and the provision of a command arming feature in accordance with the previous object which is explosive actuated and is held in either its safe or its armed position by centrifugal force imparted by rotation of the projectile. These as well as other objects and advantageous features of the present invention will be in part apparent and in part pointed out hereinafter.

In general, a safe and arm mechanism for an explosive projectile of the type subjected to both axial and angular acceleration when discharged from a rifled barrel includes a detonating device and a spin actuated escapement mechanism for delayed arming as well as a setback device normally blocking the escapement mechanism and operable upon a concurrence of axial acceleration, angular acceleration and angular velocity above predetermined thresholds to free the escapement mechanism. A command arming arrangement normally precludes movement of the escapement mechanism into a fully armed condition and is operable upon command to free the escapement mechanism to move to the fully armed position. A void sensing mechanism for sensing deceleration caused by the projectile striking a target followed by a significant reduction of that deceleration then enables the detonating device.

Also in general and in one form of the invention, a setback device in the general environment of the previous object comprises a ball for selectively blocking escapement mechanism motion and a spring normally biasing the ball toward a first escapement motion blocking position. The ball moves generally in the axial direction against the spring bias from the first position to a second position in response to axial acceleration in excess of a predetermined threshold, moves generally tangentially from the second position to a third position in response to angular acceleration in excess of a predetermined threshold, and moves generally radially from the third position to a forth position in response to centrifugal force imparted by continued spin of the projectile. The ball is free to move back to the first escapement motion blocking position from the third position in the event that axial and angular acceleration fall below the respective predetermined thresholds, but is locked in the fourth position by the spring and remains in that position regardless of decreases in axial and angular acceleration. In practice, a second independent lock in the form of the two spin-actuated spring-loaded pawls which are part of a conventional M724 runaway escapement are also employed.

Still further in general, a void sensing mechanism for an explosive projectile for sensing deceleration caused by the projectile striking a target followed by a significant reduction of that deceleration for enabling a detonating device includes a ball movable generally in the axial direction from a first position to a second position in response to the deceleration and subsequently movable from the second position to a third position in response to the reduction in deceleration. The ball moves from the second position to the third position as a result of centrifugal force on the ball due to projectile rotation with ball motion functioning to integrate distance traversed subsequent to the reduction in deceleration.

Again in general and in one form of the invention, an explosive projectile has an escapement mechanism for delayed arming, and a primary safety lock which precludes escapement mechanism operation until the projectile is discharged along with an independently operable arrangement for command arming the projectile comprising a cam surface in the escapement mechanism and a cam follower movable upon command from a first position in which completion of escapement mechanism motion is blocked to a second position allowing completion of escapement mechanism motion to fully arm the projectile. An explosive cam actuator is operable upon receipt of the command in the form of an electrical signal to move the cam follower from the first position to the second position. The first and second positions are on opposite sides of the projectile axis so that centrifugal force acting on the cam follower urges the follower to remain in the one of said positions in which the follower is located.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
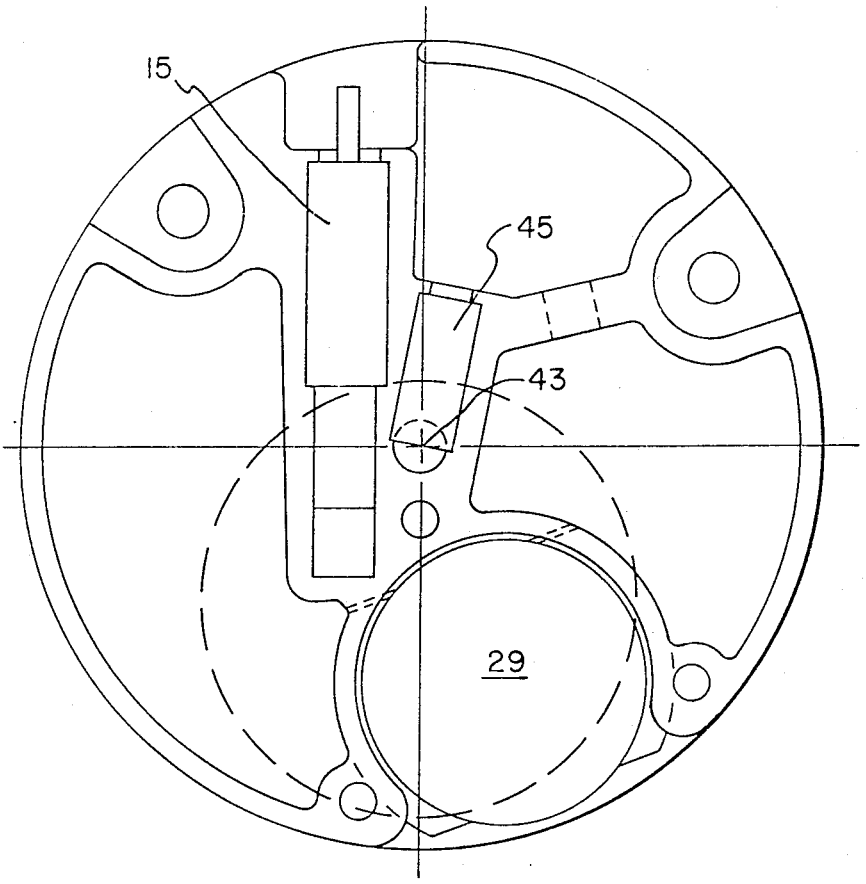
FIG. 1 is a partially cut away top view of the safe and arm mechanism of the present invention.
Figure 2:
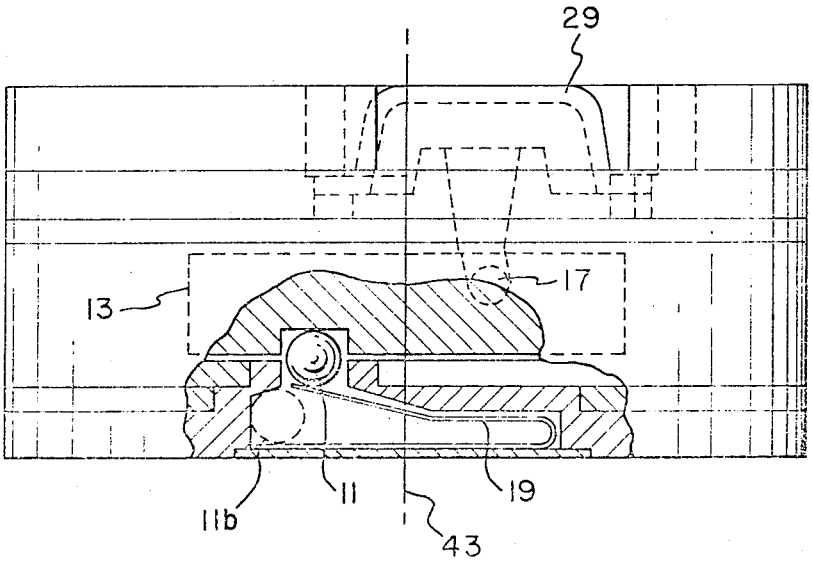
FIG. 2 is a side view, partially in cross-section, of the mechanism of FIG. 1.

Referring to the several sheets of drawing generally, the safe and arm mechanism is to be positioned in an explosive projectile (not shown) which is fired from a rifled barrel to accelerate linearly upwardly as viewed in FIG. 2 along the projectile axis 43. The projectile and the safe and arm mechanism experience angular acceleration about the axis 43 and continue to spin about that axis after leaving the barrel. The projectile first experiences axial and angular acceleration when fired which, along with the centrifugal force due to projectile rotation, moves a setback ball 11 of FIGS. 2 and 3 from the position identified as 11 to the position identified as 11*b* to initially arm the mechanism. When the projectile strikes a target, it experiences axial deceleration which moves a contact ball 17 of FIG. 6 to the position 17*a* which is partway to the detonating position 17*b*. After the projectile passes through the target surface and into a void, e.g., into the hull of a ship, the deceleration ceases and the contact ball moves, due to centrifugal force, to the position 17*b* of FIGS. 6 and 14.

Figure 4:
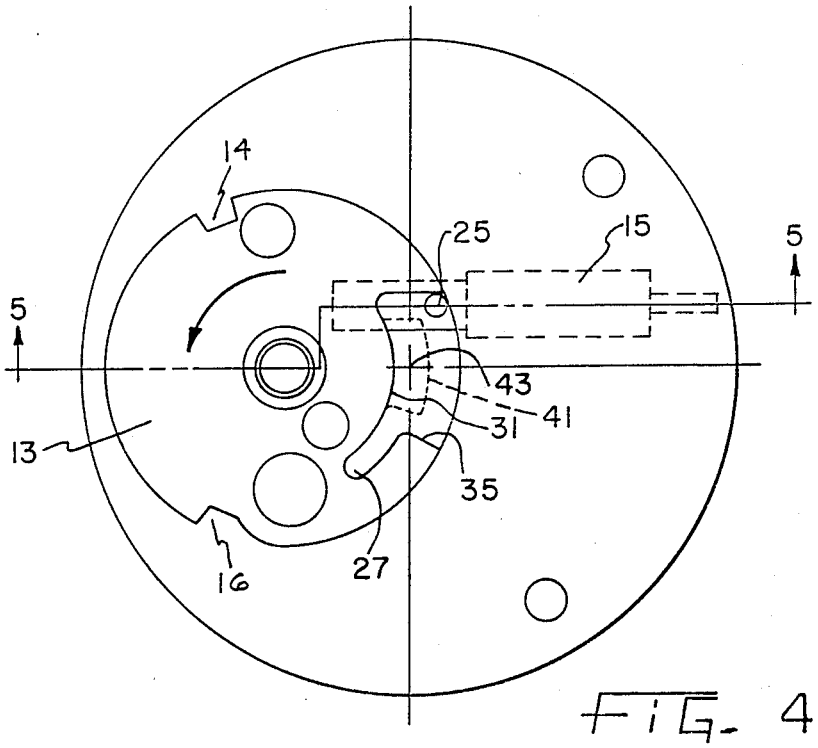
FIG. 4 is a top view of the escapement mechanism and command arm feature of the present invention.

At rest, the ball 11 is as shown in FIG. 2 above a leaf spring 19. Axial and angular acceleration of the projectile depresses the spring and the ball moves to the position 11*a*. This motion releases the rotor 13 (It was locked by ball 11 as shown in FIG. 2). Rotor 13 has a cam surface 31 and is weighted so that rotation of the projectile causes it to tend rotate in the direction of the arrow in FIG. 4. The electronically controlled actuator 15 limits this rotation from the safe position as illustrated in FIG. 4, to the fully armed position of FIG. 13 with the pin 25 resting in the reduced area 27 of the rotor 13 cam surface. In the fully armed position, the contact ball 17 is brought into alignment with the switch housing 29 as illustrated in FIG. 6.

Figure 6:
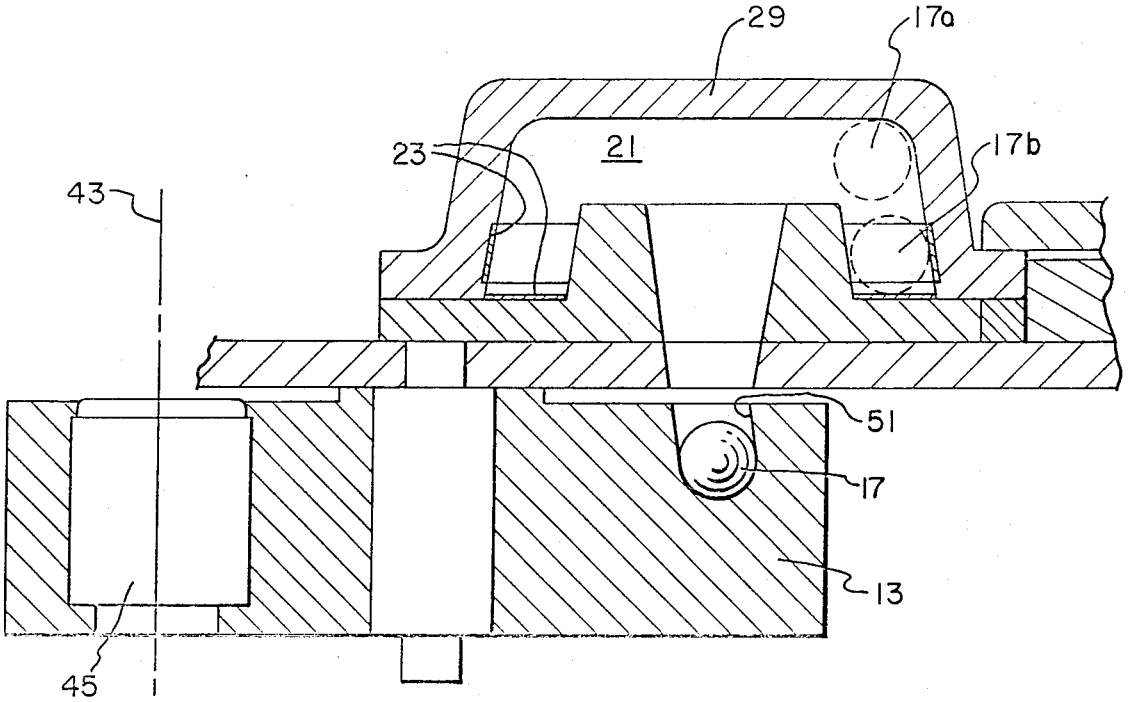
FIG. 6 is a side view in cross-section of the void sensing switch of FIGS. 1 and 2.
Figure 14:
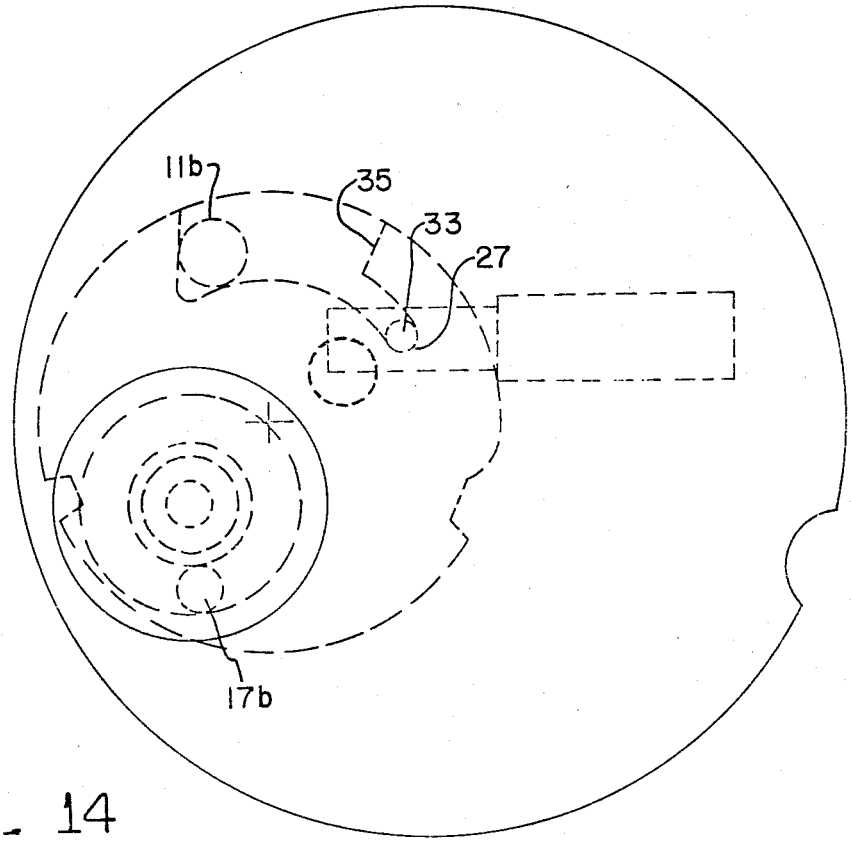

When the projectile strikes a target and decelerates, the ball 17 moves upwardly into the region 21 as shown at 17*a* and when that deceleration ceases and the projectile is, for example, inside a ship's hull, the ball 17 moves into the annular area of the contacts 23 as shown at 17*b* in FIGS. 6 and 14, shorting those contacts, and detonating the device.

The general sequence of events includes movement of ball 11 to free rotor 13 as the projectile is initially fired from a gun, rotation of rotor 13 of an escapement mechanism during projectile flight limited by electronic control and energization of actuator 15, followed by the ball 17 moving into alignment with the switch housing as in FIG. 6, and then, movement of the contact ball 17 forward (upwardly in FIG. 6), radially, and finally down to make contact between contacts 23 indicating the projectile has passed into a hull of a ship or other void after which a detonator 45 is energized and the projectile explodes.

Figure 3:
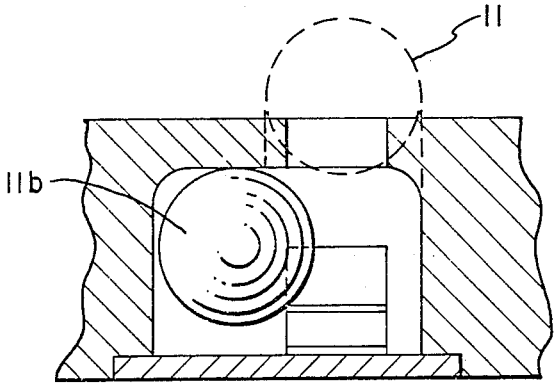
FIG. 3 is an end view of the setback device viewed from the left of FIG. 2.

Referring now in particular to FIGS. 2 and 3, the setback device or primary safety lock which precludes escapement mechanism operation until the projectile is discharged comprises a ball 11 for selectively blocking escapement mechanism motion and, in particular, for blocking rotation of the rotor 13 when in the position 11 of FIG. 2. A leaf spring 19 normally biases the ball toward the escapement motion blocking position. When the projectile is subjected to axial acceleration, the ball moves generally in the axial direction against the spring bias from the rotor blocking position to an intermediate position in response to axial acceleration in excess of a predetermined threshold. Angular acceleration causes the ball to move generally tangentially from the intermediate position to a further intermediate position 11*a* (FIG. 10) in response to angular acceleration in excess of a predetermined threshold. The results of these axial and tangential motions are seen in comparing FIGS. 9 and 10. In this further intermediate position, should the projectile motion be inadequate, the ball will be returned to the rotor blocking position by the spring 19. As the projectile gains rotational velocity, centrifugal force urges the ball radially from the further intermediate position 11*a* to a final position 11*b* in which it is trapped by the spring 19. This motion is depicted in the transition between FIGS. 10 and 11. The ball is free to move back to the escapement motion blocking position 11 from either of the intermediate positions in the event that axial and angular acceleration fall below the respective predetermined thresholds, and the ball is locked in the final position 11*b* by the spring and remains in that position regardless of decreases in axial and angular acceleration. Thus, the ball 11 moves in three generally orthogonal directions under forces created by three different parameters of projectile motion and failure to achieve any one of the three will return the ball to the rotor blocking (safe) position.

Figure 5:
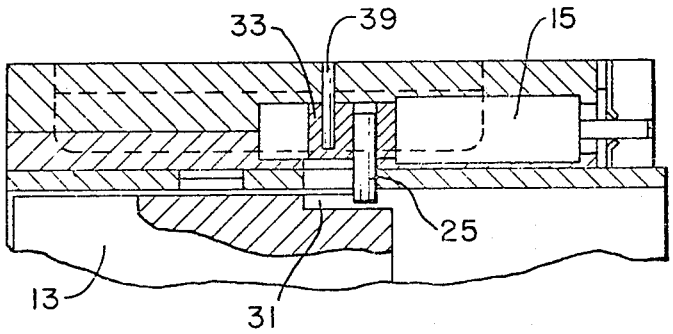
FIG. 5 is a view in cross-section along the line 5—5 of FIG. 4.

Referring now primarily to FIGS. 4 and 5, an independently operable arrangement for command arming the projectile includes a cam surface 31 in rotor 13 of the escapement mechanism and a cam follower 33 movable upon command from a first position in which completion of escapement motion is blocked by pin 25 engaging surface 35, to a second position where pin 25 is aligned with the narrow slot portion 27 allowing completion of escapement mechanism motion to fully arm the projectile. Preferably, pin 25 does not ride on surface 31, but rather, clears that surface slightly to avoid frictional drag on the escapement mechanism.

The cam in rotor 13 may optionally include the indented portion shown in dotted lines 41 in FIG. 4 so that, in the event the actuator 15 fires prematurely, the pin 25 moves into this indentation 41 and precludes rotor motion in a fail safe manner. Rotor 13 may be a portion of the aforementioned M724 escapement mechanism and may include spin-actuated spring-loaded pawls which normally engage notches 14 and 16 and function as a second independent primary safety.

Figure 7:
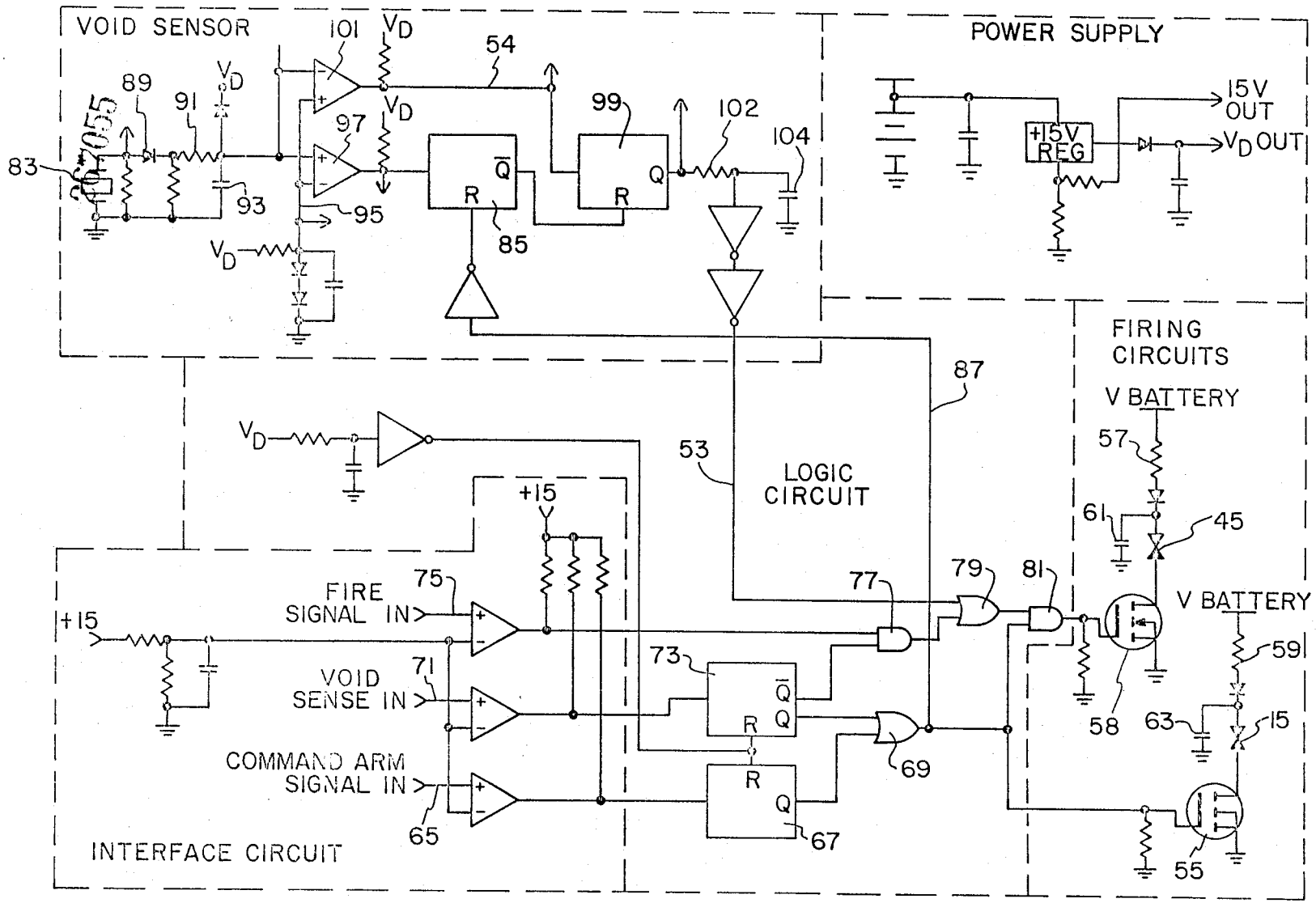
FIG. 7 is a schematic diagram of control and firing circuitry including a variation on the void sensing switch of FIG. 5.
Figure 12:
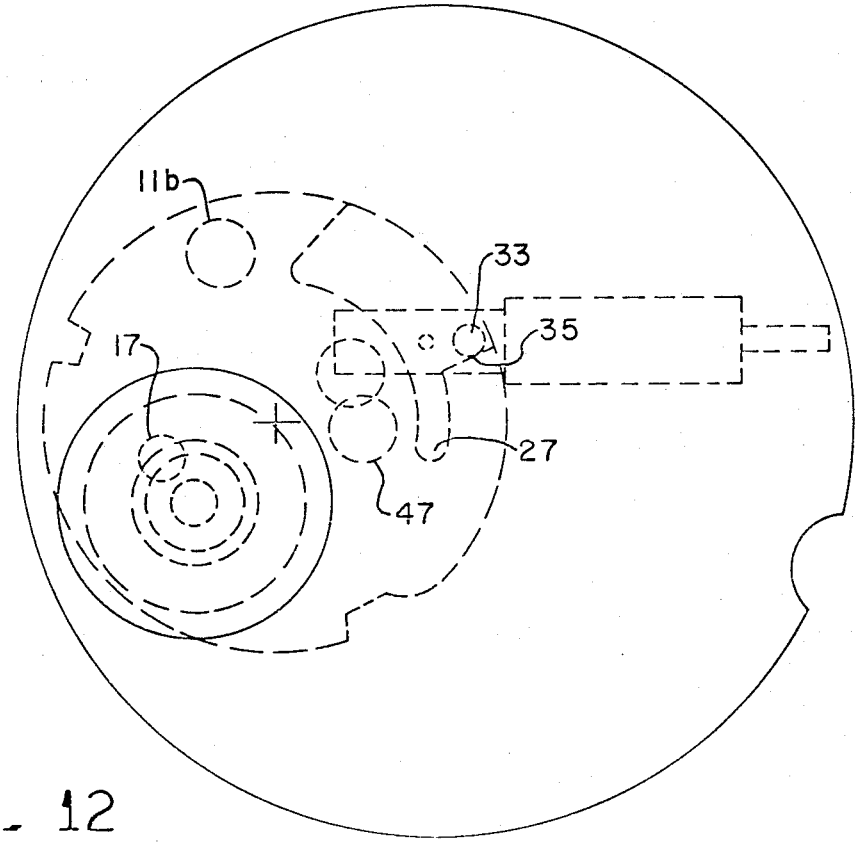
Figure 13:
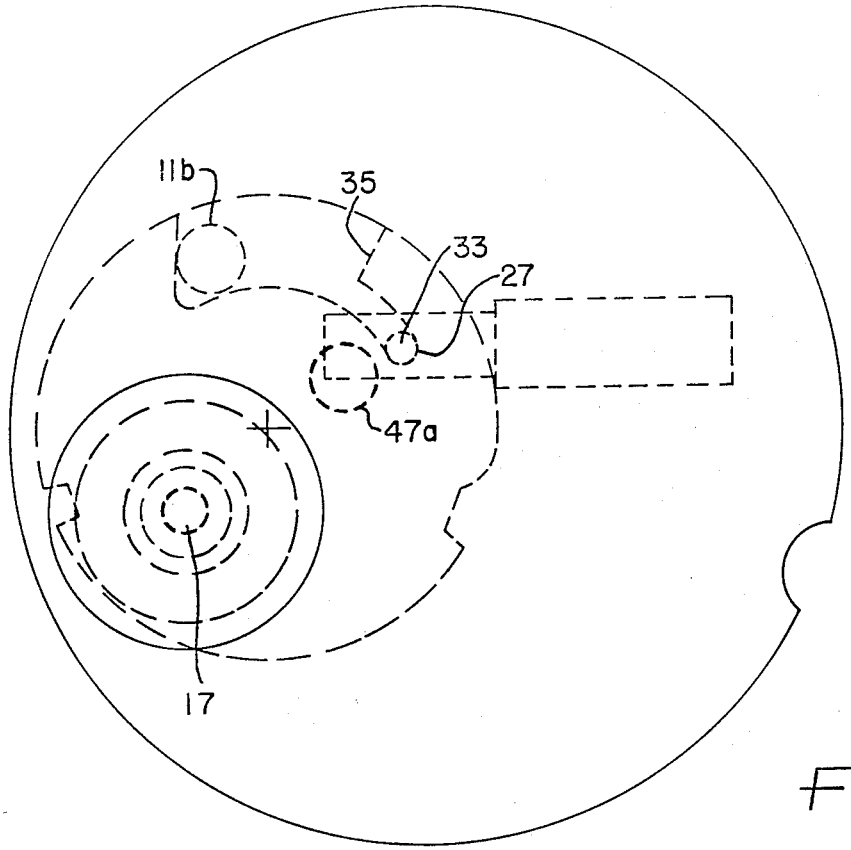

The explosive cam actuator 15 is normally operable upon receipt of an electrical signal from the circuit of FIG. 7 to move the cam follower 33 from a first position (FIGS. 4, 5 and 12) to a second position (FIG. 13). The first and second positions are on opposite sides of the projectile axis 43 so that centrifugal force acting on the cam follower urges the follower to remain in the one of said positions in which the follower is located. A shear pin 39 may also hold the follower 33 in the safe position until the actuator is triggered.

Movement of the setback ball functions as one primary safety lock to preclude operation of the escapement mechanism. At rest, the ball is positioned above a leaf spring. Axial and angular acceleration of the projectile depresses the spring and the ball moves to another position. This motion releases the rotor of the escapement mechanism. The rotor is weighted so that rotation of the projectile causes it to tend to rotate. The cam follower of an electronically controlled actuator engages a cam track in the rotor and limits this rotation in stages from the fail safe position to an intermediate position where a command arming signal is required before the rotor moves into the fully armed position. In the fully armed position, a contact ball is brought into alignment with a switch housing.

Figure 8:
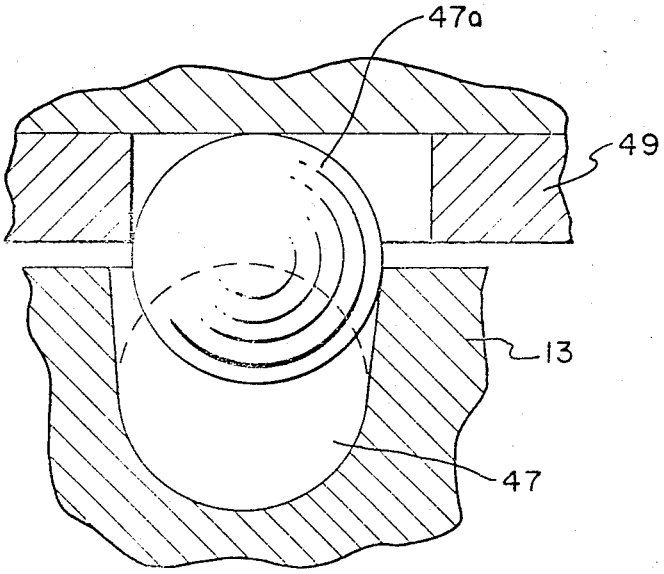
FIG. 8 illustrates the function of a rotor lock ball which holds the rotor in the armed position.

A rotor lock ball 47 is illustrated in FIGS. 8, 12 and 13. This ball 47, which is normally housed within the rotor 13, moves forward or upwardly as viewed in FIG. 8 due to centrifugal force and the slight deceleration due to projectile aerodynamic drag, along a slight slope from the position 47 of FIGS. 8 and 12 to the position 47*a* of FIGS. 8 and 13 when the rotor 13 reaches the fully armed position to lock the rotor 13 to the top plate 49 holding the rotor 13 in that position.

Referring now to FIGS. 2, 6 and 9–14, a void sensing mechanism for sensing deceleration caused by the projectile striking a target followed by a significant reduction of that deceleration for enabling the detonating device includes a ball 17 movable generally in the axial direction from a first position 17 of FIGS. 2, 6 and 9–13, to a second position 17*a* in FIG. 6, in response to the deceleration and subsequently moves from the second position to a third position, 17*b* in FIGS. 6 and 14, in response to the reduction in deceleration. Selection of the slope of the slightly inclined surface 51 may be made to tailor the void sensing arrangement to a particular target. The ball 17 moves from the second position to the third position as a result of centrifugal force on the ball due to projectile rotation with ball motion functioning to integrate the distance traversed subsequent to the reduction in deceleration.

Figure 9:
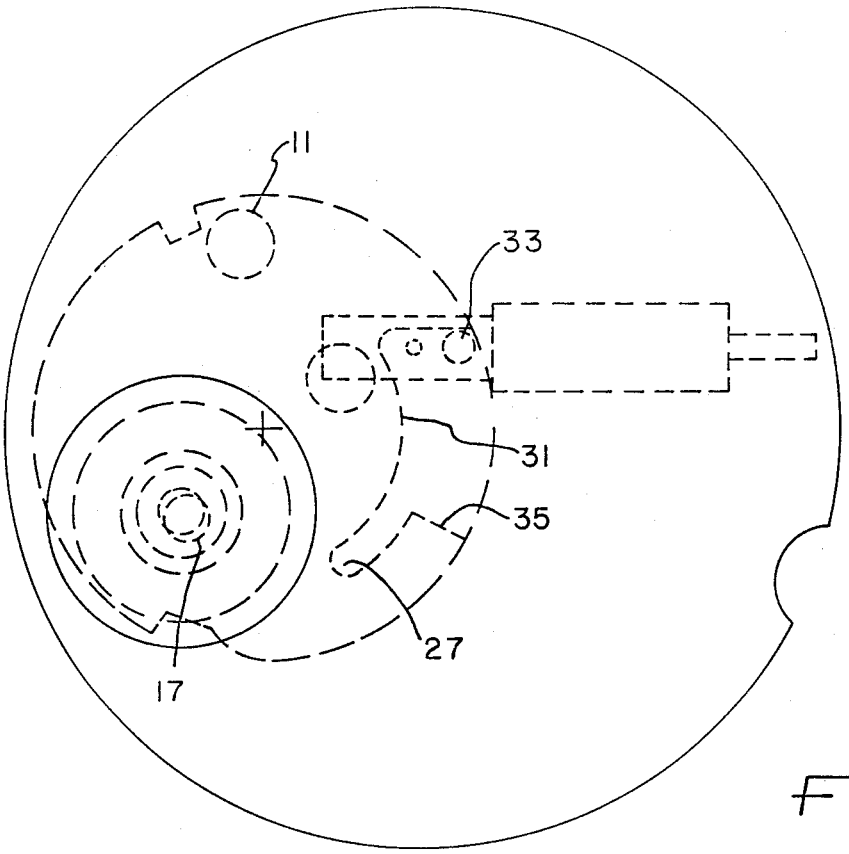
FIGS. 9–14 are top views similar to FIG. 1 illustrating the sequence of operation of the invention.
Figure 10:
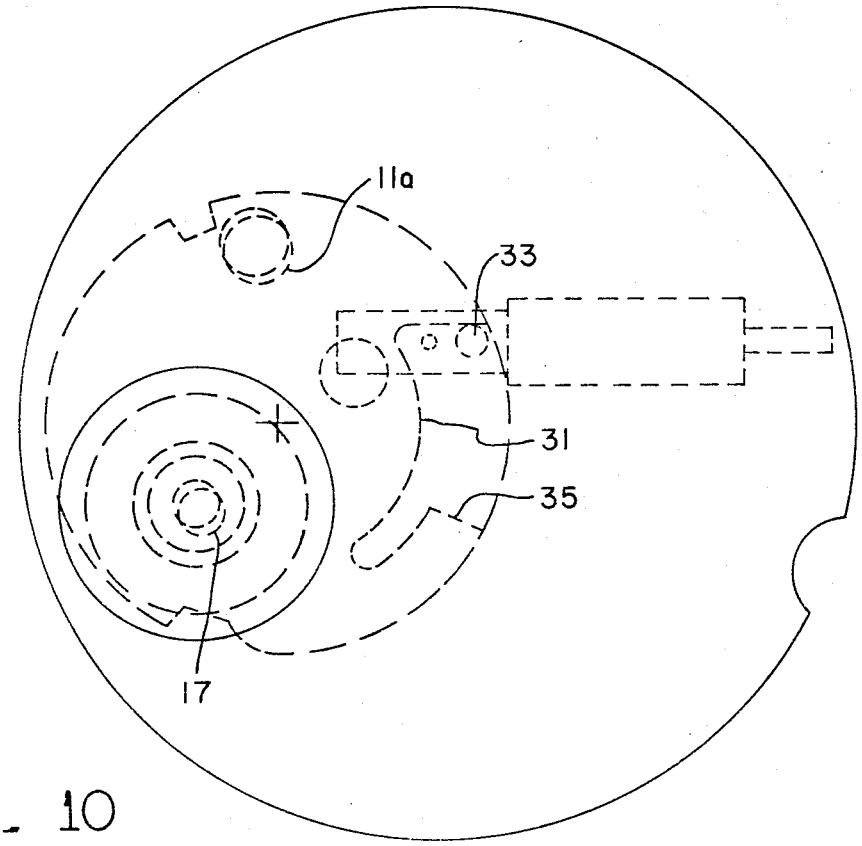
Figure 11:
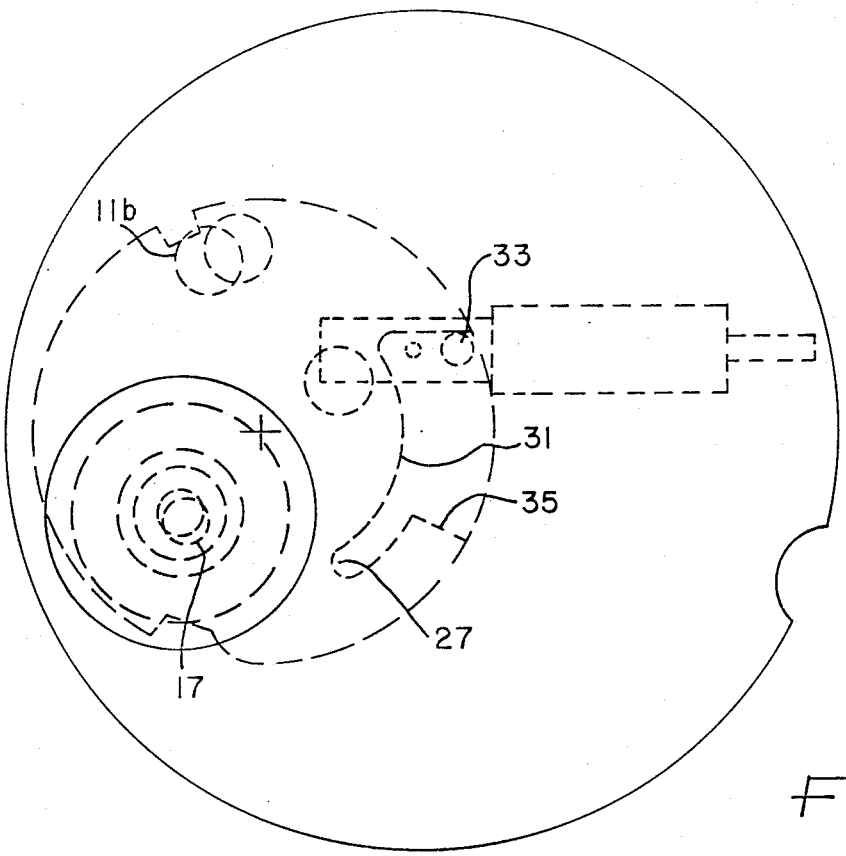

FIGS. 9–14 pretty well summarize the sequence of events from firing the projectile to detonation of the explosive. In FIG. 9, the setback ball 11 is in the rotor locking position. In FIG. 10, the setback ball has moved to the partially armed position, but is not yet held in position by the spring 19. In FIG. 11, the setback ball is in the fully armed position and held there by spring 19. Rotor 13 is now free to move. In FIG. 12 the rotor has gone as far through the delay arm cycle as the cam follower will permit. Energization of the actuator 15 moves the follower 33 to the position of FIG. 13 and the rotor is free to continue rotation. After impact and passing into a void, the contact ball assumes the position of FIG. 14 closing the contacts 23.

When the projectile strikes a target and decelerates, the contact ball moves upwardly into an annular region and when that deceleration ceases and the projectile is in a void such as inside a ship's hull, the ball moves rearwardly and outwardly in the annular area connecting a pair of contacts and detonating the device some distance beyond the point of impact.

The several options for detonating the projectile may be readily understood from a consideration of the safe and arm circuitry of FIG. 7. This circuit is functionally divided by the dotted lines into a power supply for supplying the necessary voltages to the various components, an interface circuit which matches the voltage level outputs from a controller to the logic circuit, a logic circuit which, upon the appropriate inputs, enables the firing circuits, and an optional piezoelectric void sensing circuit. If the mechanical void sensing switch of FIG. 6 is used, the closure of its contacts merely applies an appropriate voltage to line 54 and the remaining void sensor portion of FIG. 7 may be omitted.

In FIG. 7, the actuator 15 is triggered and the rotor 13 released when the field effect transistor (MOSFET) 55 is turned on to discharge the capacitor 63. Similarly, the detonator 45 is fired when the MOSFET 58 is turned on to discharge the capacitor 61. Current limiting resistors 57 and 59 prevent accidental initiation of the actuator and detonator. Receipt of a command arm signal on line 65 sets the latch 67 and, by way of OR gate 69, turns on MOSFET 55 to initiate the actuator 15. The actuator 15 is similarly fired if a void sense mode signal is received on line 71 setting the latch 73. Receipt of a fire signal on line 75 with latch 73 in its reset condition (no void sense mode signal) will, by way of AND gate 77, OR gate 79 and AND gate 81, to turn on MOSFET 57 and initiate the detonator 45. Such firing, of course, presumes a previous actuator enabling signal from OR gate 69. If latch 73 is set, the device is in the void sense mode and AND gate 77 will prevent a fire signal on line 75 from detonating the device.

The electronic void sensor of FIG. 7 relies on the voltage generated by compression, upon impact, of piezoelectric crystal 83. The subsequent relaxation of the compression and generation of a voltage of opposite polarity occurs when the projectile passes into a void. Latch 85 is preliminarily reset when MOSFET 55 is turned on by a signal on line 87. The crystal output is rectified by diode and passes through a low pass filter including resistor 91 and capacitor 93 which limits false triggering signals. If the crystal output exceeds the reference voltage on line 95, comparator 97 is triggered setting latch 85 and releasing latch 99. As the crystal output drops to the reference voltage, inverting comparator 101 is triggered, setting latch 99 and providing the void sense signal on line 53. Latch 99 is set as the projectile emerges into the void. Electronic delay of the detonation signal to insure that the projectile has entered the void may be provided by capacitor 104 and resistor 102 if desired.

From the foregoing, it is now apparent that a novel multi-option safe and arm arrangement for artillery has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. In a safe and arm mechanism for an explosive projectile of the type subjected to both axial and angular acceleration when discharged from a rifled barrel, the mechanism including a detonating device and an escapement mechanism for delayed arming, an improved primary safety lock which precludes escapement mechanism operation until the projectile is discharged comprising:

a ball for selectively blocking escapement mechanism motion and a spring normally biasing the ball toward a first escapement motion blocking position, the ball moving generally in the axial direction against the spring bias from the first position to a second position in response to axial acceleration in excess of a predetermined threshold, the ball moving generally tangentially from the second position to a third position in response to angular acceleration in excess of a predetermined threshold, and the ball moving generally radially from the third position to a forth position in response to centrifugal force imparted by continued spin of the projectile.

2. The improvement of claim 1 wherein the primary safety lock requires the concurrence of three projectile motion parameters to free the escapement mechanism, namely axial acceleration, rotational acceleration and rotational velocity and wherein the spring is a leaf spring, the leaf spring urging the ball to move back to the first escapement motion blocking position from each of the second and third positions in the event that axial and angular acceleration fall below the respective predetermined thresholds, the ball being locked in the fourth position by the leaf spring and remaining in that position regardless subsequent of decreases in axial and angular acceleration.

3. The improvement of claim 1 further comprising a setback device normally blocking the escapement mechanism and operable upon at least axial acceleration above a predetermined threshold to free the escapement mechanism, and a command arming arrangement normally precluding movement of the escapement mechanism into a fully armed condition and operable upon command to free the escapement mechanism to move to the fully armed position.

4. The improvement of claim 3 wherein the command arming arrangement includes a cam surface in the escapement mechanism and a cam follower movable upon command from a first position in which completion of escapement motion is blocked to a second position allowing completion of escapement mechanism motion to fully arm the projectile, and a cam actuator for moving the cam follower from the first position to the second position.

5. The improvement of claim 4 wherein the cam surface includes a fail-safe portion which prevents escapement mechanism motion in the event the cam follower is prematurely moved from the first position.

6. The improvement of claim 4 wherein the cam actuator is an explosive cam actuator operable upon receipt of an electrical signal to move the cam follower from the first position to the second position.

7. The improvement of claim 6 wherein the first and second positions are on opposite sides of the projectile axis so that centrifugal force acting on the cam follower urges the follower to remain in one of the said positions in which the follower is located.

* * * * *